US005980067A

United States Patent [19]

Albou et al.

[11] Patent Number: 5,980,067

[45] Date of Patent: Nov. 9, 1999

[54] INDICATOR LIGHT FOR A MOTOR VEHICLE, HAVING A FACETED REFLECTOR

[75] Inventors: Pierre Albou, Paris; Jean-Claude Gasquet, Saint-Clement, both of France

[73] Assignee: Valeo Vision, Bodigny Cedex, France

[21] Appl. No.: 08/931,875

[22] Filed: Sep. 17, 1997

[30] Foreign Application Priority Data

Sep. 18, 1996 [FR] France ..... 96 11418
Sep. 19, 1996 [FR] France ..... 96 11419

[51] Int. Cl.[6] ..... F21V 7/00

[52] U.S. Cl. ..... 362/303; 362/327; 362/331; 362/518; 362/521

[58] Field of Search ..... 362/303, 301, 362/327, 331, 517, 518, 521, 522, 348

[56] References Cited

U.S. PATENT DOCUMENTS

| | | | |
|---|---|---|---|
| 4,153,929 | 5/1979 | Laudenschlarger et al. . | |
| 5,081,564 | 1/1992 | Mizoguchi et al. . | |
| 5,582,481 | 12/1996 | Natsume | 362/522 |
| 5,603,561 | 2/1997 | Ohishi | 362/522 |

FOREIGN PATENT DOCUMENTS

| | | |
|---|---|---|
| 0 678 703 | 10/1995 | European Pat. Off. . |
| 2 476 798 | 8/1981 | France . |
| 2 508 597 | 12/1982 | France . |
| 43 17 50 | 7/1926 | Germany . |
| 40 21 987 | 9/1991 | Germany . |
| 2 070 222 | 9/1981 | United Kingdom . |
| 2 108 256 | 5/1983 | United Kingdom . |

*Primary Examiner*—Nimeshkumar D. Patel
*Assistant Examiner*—Todd Reed Hopper
*Attorney, Agent, or Firm*—Morgan & Finnegan, LLP

[57] ABSTRACT

An indicator light for a motor vehicle includes a lamp, a reflector, a cover lens, and a screen placed between the lamp and the cover lens so as to mask the lamp. The reflector has a set of deflecting panels or facets, adjacent to each other and arranged to generate a plurality of secondary light sources visible within a given field of observation.

Each deflecting panel comprises a central zone having a contour, projected orthogonally on the optical axis, which is generally rectangular with horizontal and vertical sides and adapted to cover the whole field of illumination, together with at least one pair of peripheral zones with oblique sides, smoothly extending the central zone on two opposed sides of the central zone. The peripheral zones together also cover the whole field of illumination. Each deflecting panel reveals at least two virtual light sources within a given field of observation, when viewed from any angle within that field. The screen is a translucent plate having retro-reflective optical means on one of its faces, and includes means for generating further secondary light sources, in a distribution similar to that of the secondary sources generated by the deflecting panels and visible in the same field of observation.

10 Claims, 9 Drawing Sheets

INDICATOR LIGHT FOR A MOTOR VEHICLE, HAVING A FACETED REFLECTOR

FIELD OF THE INVENTION

The present invention relates to indicator lights (also referred to in this Application as indicating lights) for motor vehicles, generally of kinds intended to be viewed from outside the vehicle. More particularly, the invention relates to indicator lights comprising a filament lamp and a cover lens, together with a flux recuperator consisting of a reflector divided into a set of deflecting panels or facets. The invention is also concerned with an indicator light of this type which also includes a screen or mask for masking the light source, i.e. the lamp, so that the latter is not directly viewed from outside.

BACKGROUND OF THE INVENTION

In such an indicator light, each facet of the mirror has a form such that it is adapted to direct the reflected light horizontally and vertically, so that the facet by itself covers at least part of the field of illumination of the indicating light. As a result, when the indicating light is observed within this field of illumination, and whether or not the cover lens is smooth or, as may be the case, includes reliefs such as decorative elements, which have little influence on the behaviour of the radiated light, it is found that there occur a number of secondary light sources which are spaced apart at regular intervals. These secondary light sources are created by the various facets of the mirror, and they give the indicating light an aspect which is sometimes called a "diamond aspect". This diamond aspect is very attractive to styling designers.

An indicating light with these features is quite easy to design when each of the facets has, in orthogonal projection on the optical axis, horizontal and vertical sides, because each facet can then easily be designed in such a way as to distribute the light projected in a rectangle which is selected so as to be equal or similar to the required field of illumination, the latter being also generally of rectangular form.

However, this constraint regarding the edges of the facets involves some penalties for the stylist. In this connection, the stylist may want the contours of the facets to be, not horizontal and vertical, but with oblique orientations instead, following for example the contour lines of the neighbouring parts of the bodywork of the vehicle. But if the facets are to have such contours, it becomes impossible to make them able to cover a projected field of illumination corresponding closely enough to the required rectangular field of illumination. In that case, when the observer, outside the vehicle, is close to the edges of the field of illumination, or moves progressively away from this field, some of the secondary light sources cease to be visible to the observer, while others remain visible. From the styling point of view this effect is regarded as being extremely undesirable.

DISCUSSION OF THE INVENTION

The present invention aims to overcome this limitation in the state of the art, and to propose an indicator light having a faceted reflector with good optical performance, the contours of which can be determined in a much more flexible way than hitherto, while the feature whereby all of the facets illuminate substantially the same field is preserved.

A connected object of the present invention is to provide an indicator light of the above type, in which the geometry of the field of illumination projected by each facet or deflecting panel of the reflector is relatively independent of the geometry of the contours of the deflecting panel.

A further object of the present invention is to provide an indicating light of the above mentioned type having a homogeneous appearance (aspect) regarding the screen that masks the lamp, both when the light is extinguished and when it is lit.

According to a first aspect of the invention, an indicator light is provided for a motor vehicle, comprising a light source, a reflector which includes a set of deflecting panels adjacent to each other, and a cover lens, the deflecting panels having continuous reflective surfaces each of which distribute the light emitted from the light source into a given field of illumination, having a horizontal dimension and a vertical dimension, the cover lens being of either smooth or a slightly deflecting configuration, wherein each deflecting panel comprises a central zone having a contour, in orthogonal projection along the optical axis, which is generally rectangular with horizontal and vertical sides, the central zone being adapted to cover the whole of the field of illumination, and at least one pair of peripheral zones with oblique sides, the said peripheral zones extending the central zone, with continuity and without any sudden change of gradient, on two opposed sides of the central zone, the peripheral zones being adapted so as together to cover the whole of the field of illumination.

According to a preferred feature of the invention, the central zone is defined by a law for the evolution of the horizontal deflection of the light rays emitted from the light source as a function of a horizontal direction, and by a law for the evolution of the vertical deflection of the light rays emitted from the light source as a function of a vertical direction, and the peripheral zones that constitute a pair of peripheral zones follow a first evolution law identical to one of the said laws of evolution of the central zone, and a second evolution law which is the inverse of the other evolution law of the central zone.

According to another preferred feature of the invention, the contour of each peripheral zone in orthogonal projection is a triangle, of which a first side is coincident with a side of the central zone, a second side is an extension of an adjacent side of the central zone, and the third side is a hypotenuse of the triangle, constituting the said oblique side of the peripheral zone.

According to a second aspect of the invention, an indicator light is provided for a motor vehicle, comprising a light source, a reflector which includes a set of deflecting panels adjacent to each other, and a cover lens, the deflecting panels having continuous reflective surfaces, continuous with each other and without any sudden change in gradient, each deflecting panel being adapted to distribute the light emitted from the light source into a given field of illumination having a horizontal dimension and a vertical dimension, the cover lens being either smooth or of slightly deflecting configuration, wherein each deflecting panel of at least one group of deflecting panels has a sinuous profile, in at least in one of its horizontal and vertical sections, and that each deflecting panel causes at least two virtual light sources to appear when seen at any angle of observation whatsoever within a given field of observation.

According to a third aspect of the invention, an indicator light is provided for a motor vehicle, of the type comprising a light source, a reflector which includes a set of deflecting panels adjacent to each other, and a cover lens, the deflecting panels having reflective surfaces continuous with each other and without any sudden change of gradient, each deflecting panel being adapted to distribute the light emitted from the light source into a given field of illumination having a horizontal dimension and a vertical dimension, the cover lens being either smooth or of slightly deflecting configuration, wherein at least some of the deflecting panels, in orthogonal projection on the central axis along which light is emitted by the indicator light, have a contour comprising at least two opposed oblique sides, and in that the panels reflect the light emitted from the source into a field of illumination which is essentially rectangular with horizontal and vertical sides.

According to a fourth aspect of the invention, an indicator light is provided for a motor vehicle, comprising a lamp, a reflector including a set of deflecting panels adjacent to each other and adapted to create a plurality of secondary light sources visible within a given field of observation when the indicator light is lit, a cover lens, and a masking screen for the lamp, the screen being placed between the lamp and the cover lens and being adapted to mask the presence of the lamp, wherein that the screen consists of a translucent plate having, on one of its faces, retro-reflective or essentially retro-reflective optical means, and in that the screen further includes means for generating further secondary light sources, the distribution of which is similar to the distribution of the secondary light sources generated by the said deflecting panels, and which are visible within a similar field of observation.

According to a further preferred feature of the invention, the means for generating the further secondary light sources comprise internal convex surfaces distributed between locations on the inner face of the plate, retro-reflective means being absent from the said locations, so that the said locations constitute windows through which light can pass.

Preferably, the windows for passing light are adapted to correct the direction of the light obtained by means of the internal convex surfaces, whereby this light fills the field of observation.

The retro-reflective elements of the screen are preferably distributed in zones having contours to reinforce the homogeneity of the aspect obtained with the deflecting panels of the reflector.

In preferred embodiments of such an arrangement, the retro-reflective zones are separated from each other by essentially smooth narrow zones.

Further objects, features and advantages of the present invention will appear more clearly on a reading of the following detailed description of some preferred embodiments of the invention, given by way of non-limiting example only and with reference to the accompanying drawings.

BRIEF DESCRIPTION OF THE DRAWINGS

FIG. 3 illustrating the behaviour of the indicator light of the invention as compared with the prior art.

DESCRIPTION OF PREFERRED EMBODIMENTS OF THE INVENTION

Figure 4:
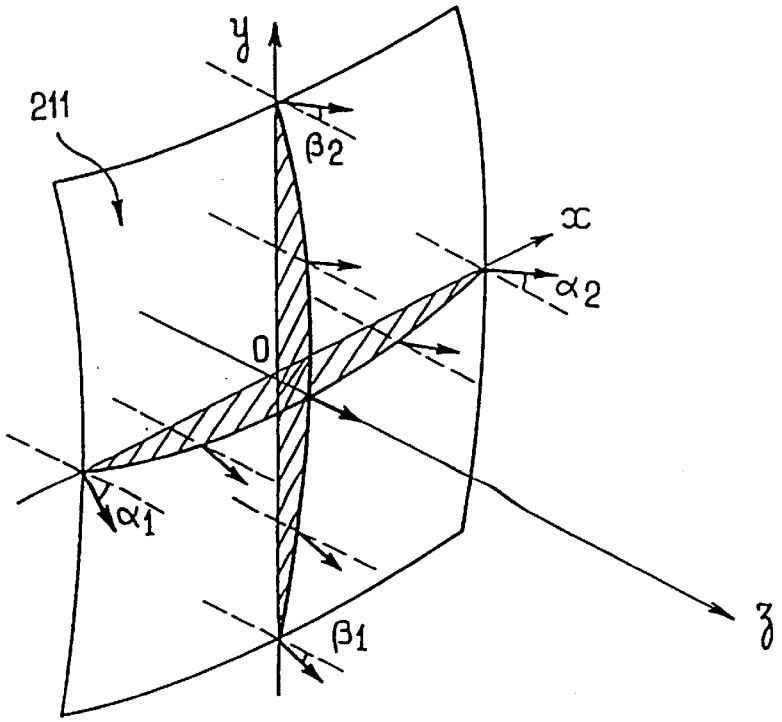
FIG. 4 is a perspective view of part of a reflective deflecting panel, or facet, of the reflector in the indicator light of FIGS. 1 and 2, shown in FIG. 4 with respect to an imaginary plane which is orthogonal to the optical axis.

First of all, it should be noted that, in the following description, the definition of the various zones of the panels, in terms of horizontal and vertical profiles, is a relative definition which is determined with respect to a parabolic profile focused on the source. Such a parabolic profile has the property that it gives no deflection of the light emitted from the source, at any point whatsoever. In addition, representation in FIG. 4 is also a relative representation in the sense that the zone of the panel which is shown in FIG. 4, and also its profiles, are those which are obtained with respect to the above mentioned parabola.

Figure 1:
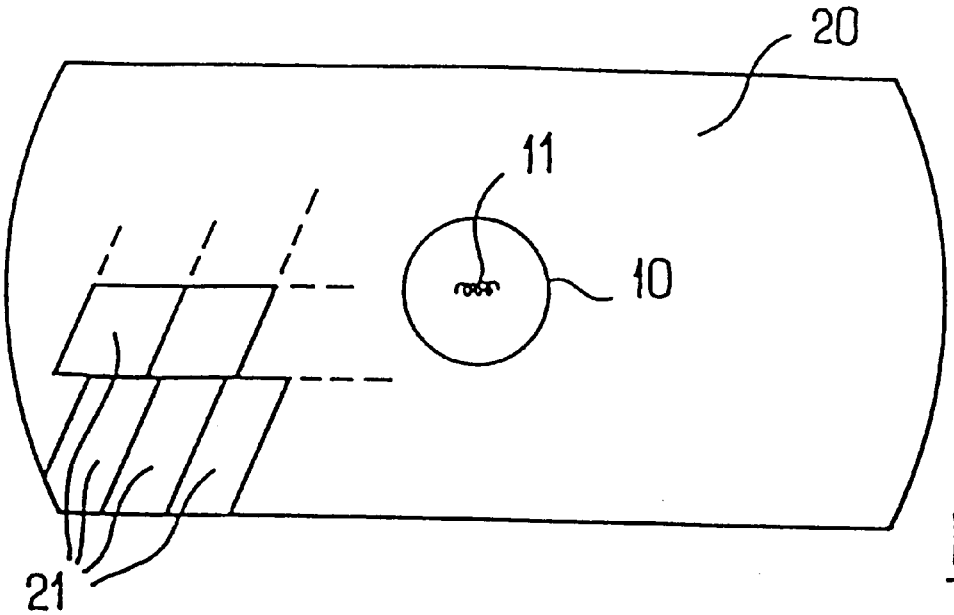
FIG. 1 is a diagrammatic front view of a reflector and filament lamp of an indicator light in accordance with the invention.
Figure 2:
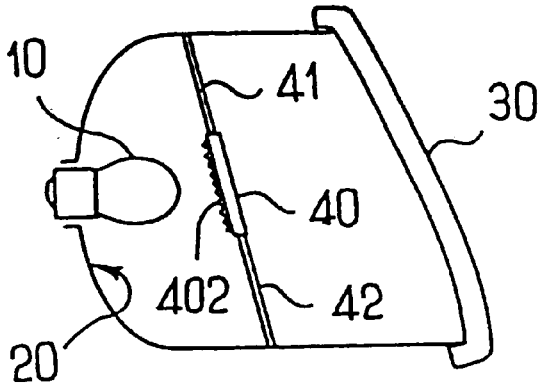
FIG. 2 is a diagrammatic view, in vertical axial cross section, of an indicator light in accordance with the invention.

With reference first to FIGS. 1 and 2, these Figures show diagrammatically an indicator light for a motor vehicle which includes a lamp 10 having a filament 11, a reflector 20, or flux recuperating mirror, and a cover lens 30. The cover lens 30 is essentially smooth, in the that it does not include any optical element that would have a significant effect on the trajectory of the light rays passing through it.

The reflector 20 is formed with a set of facets or deflecting panels 21, which may or may not be contiguous with each other: in particular, the panels may be slightly spaced apart from each other so as to leave room for the inclined stripping surfaces which are necessary during removal from a mould. In the present example these panels have a contour, in orthogonal projection along the optical axis, in the form of a parallelogram with its upper and lower edges horizontal and with its side edges oblique. This contour is however, in no way limiting, as will be seen later in this description.

Figure 3:
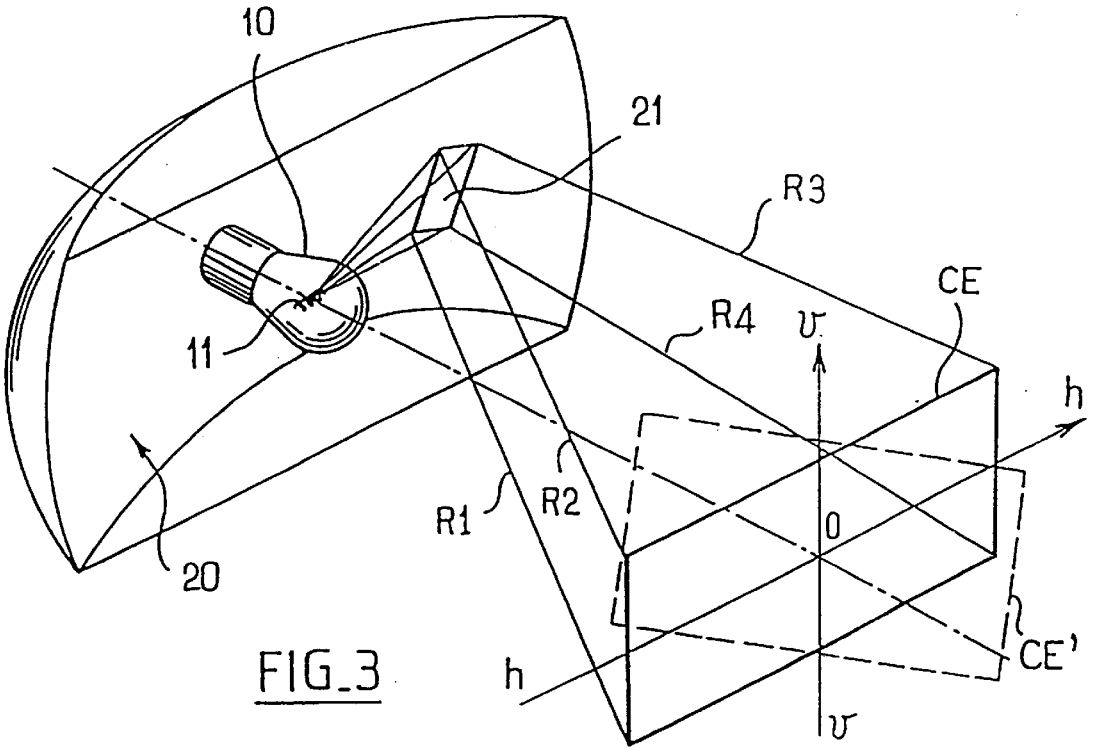
FIG. 3 is a simplified perspective view of the indicator light seen in FIGS. 1 and 2, together with a projection screen.

Reference is now made to FIG. 3, in which it will be noted that each deflecting panel 21 is capable of retransmitting the light emitted from the filament 11 of the lamp in a well-defined field of illumination CE, which is preferably common to all of the deflecting panels. In this example, the illuminating field CE is in the form of a rectangle, the major sides of which extend horizontally. Here it will be noted that with classical techniques for defining the geometrical surfaces of the various deflecting panels 21, it is impossible to obtain such a field of illumination with panels which, in orthogonal projection along the optical axis, have contours which are not rectangular, the sides of which are not horizontal and vertical.

More precisely, and still with reference to FIG. 3, a deflecting panel 21 with contours in the form of a parallelogram, as shown, could only produce a field of illumination in which at least one pair of sides are oriented obliquely, as indicated in broken lines representing a field of illumination CE'. As a result of this, and as explained in the introductory part of the present Application, optical performance is unsatisfactory, in the sense that the various deflecting panels must, in order to cover collectively the rectangular field of illumination imposed by photometric regulations, have individual fields of illumination which are substantially different from each other, with the above mentioned non-simultaneous effects of lighting and extinction of the secondary sources.

The construction of a deflecting panel, at least part of which has contours with an oblique orientation, will now be described in detail with reference to FIG. 4.

In accordance with an important feature of the present invention, a rectangular central zone 211, the sides of which are horizontal and vertical, is defined within the contours of the deflecting panel. A specific position in terms of depth, defined along the optical axis of the indicator light and indicated at Oz in FIG. 4, is allocated to this zone. Also allocated to it is a continuous monotone function of the angle of reflection projected in a horizontal plane, as a function of the location of the point on the surface in the horizontal direction at right angles to the optical axis, i.e. along the axis Ox in FIG. 4. This function is denoted as $\alpha=f(x)$. Finally, a continuous monotone function of the angle of reflection projected in a vertical plane is imposed as a function of the location of the point on the surface in the vertical direction at right angles to the optical axis, i.e. along the axis denoted Oy in FIG. 4. This function is noted $\beta=g(y)$.

The position of the light source (which is represented as a point here in the interests of simplification) is known, so that a single surface which satisfies these various constraints can be obtained using the Descartes equations. Thus, FIG. 4 illustrates the surface of a central zone 211 which, in terms of its width, provides a horizontal deflection which varies progressively from one side to the other between a deflection $\alpha 1$ and a deflection $\alpha 2$ in the opposite sense, passing locally, at the centre 0 of the panel (or facet) through a deviation $\alpha 0$ which is preferably zero.

Similarly, in terms of its height or vertical depth, the surface provides a vertical deflection which varies progressively from one horizontal side of the rectangle to the other, between a deviation $\beta 1$ and a deviation $\beta 2$ in the opposite direction, passing locally, at the centre 0 of the facet, through a deviation $\beta 0$ which is preferably zero.

The angles $\alpha 1$, $\alpha 2$ and $\beta 1$, $\beta 2$ are selected as a function of the required field of illumination, such as the field CE in FIG. 3. In most cases, this field of illumination is symmetrical about the horizontal axis and about the vertical axis, so that $\alpha 1$ and $\beta 1$ are chosen so as to be equal to $-\alpha 2$ and $-\beta 2$ respectively.

Thus the central zone of each deflecting panel or facet integrally fills the field of illumination CE, which is preferably the same for all of these panels. This filling is obtained with satisfactory homogeneity to the extent that the deflection functions f and g are of regular form, as will be seen in detail later in this description.

The central zone 211 of the deflecting panel 21 discussed above is completed, on at least two of its opposed sides, by peripheral zones which are preferably triangular. The surfaces of these peripheral zones have the property of being continuations of the surface of the central zone 211, and of displaying deflection laws which, in one of the two dimensions, are inverse to the deflection laws in the central zone 211.

Figure 5A:
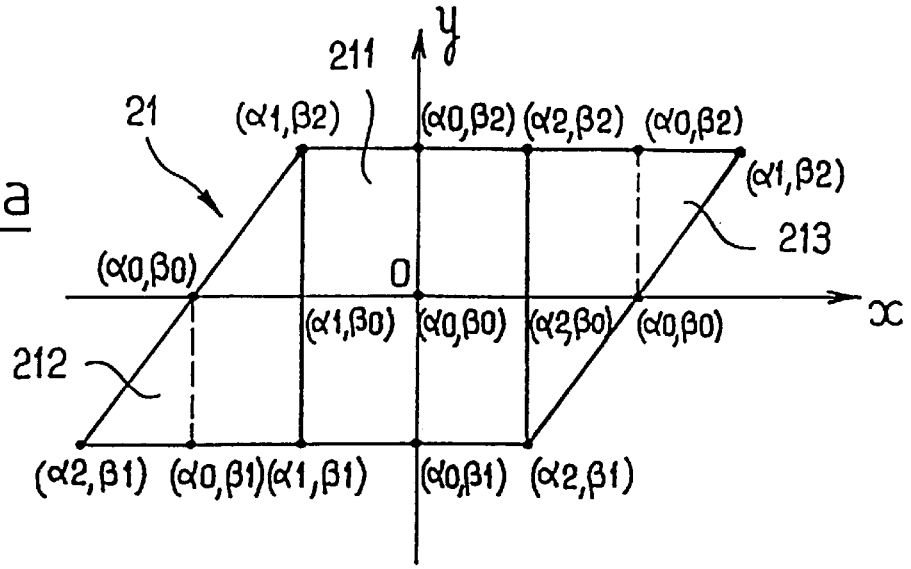
FIG. 5*a* shows a first example of a deflecting panel for an indicator light in accordance with the invention, in orthogonal projection along the optical axis.

FIG. 5*a*, to which reference is now made, shows a first example of this, illustrating the case in which the central zone 211 is completed by two triangular peripheral zones 212 and 213 which are situated on either side of the central zone. The lateral zone 212 has, in orthogonal projection along the optical axis, a contour which includes a first vertical side coincident with the left hand lateral side of the central zone; a second horizontal side which constitutes an extension of the lower side of the central zone 211, an d which has a length which in this case is equal to that of the lower side; and a third side which is the hypotenuse of the triangle and extends obliquely between the ends of the first two sides.

The lateral zone 213 has, in orthogonal projection along the optical axis, a contour having the same form and the same dimensions as the contour of the lateral zone 212, but turned through 180 degrees with respect to the latter.

The reflective surfaces of the two lateral zones 212 and 213 are such that, if they were juxtaposed to each other along their hypotenuse, a surface would be obtained, the behaviour of which in terms of horizontal deflection would be the inverse of the behaviour of the central zone. In other words, the deflection obtained would pass progressively, from left to right, from the value $\alpha 2$ to the value $\alpha 1$, passing locally through the value $\alpha 0$.

Put another way, the two lateral zones, when juxtaposed as described above, would define a surface with a concave horizontal profile which is inverse to the convex horizontal profile of the central zone 211. By contrast, the vertical profile of the deflecting panel or facet is in this case convex over its whole area. FIG. 5*a* shows the horizontal and vertical deflections obtained at different points on the panel 21.

It will be seen in particular in FIG. 5*a* that, at the boundary between each lateral zone 212, 213 and the central zone 211, the light rays are reflected in the same direction on the lateral zone concerned, and on the central zone, so that each lateral zone extends the central zone with continuity, without any change of gradient. In addition, the two lateral zones 212 and 213 together fill the same rectangular field of illumination CE as the central zone 211, with each of the lateral zones providing essentially one half of this filling, these two halves being separated by a diagonal of the field CE.

Thus, the deflecting panel 21 as a whole fills a field of illumination which is the rectangular field CE subject only to variations that may be due, in particular, to the fact that the light source is not in practice a point source. In addition, for an observer located within the field CE, the panel 21 generates two virtual secondary sources, one of which is produced by the central zone 211, the other being produced either by the lateral zone 212 or by the lateral zone 213, according to the position of the eye of the observer within the field CE.

Figure 5B:
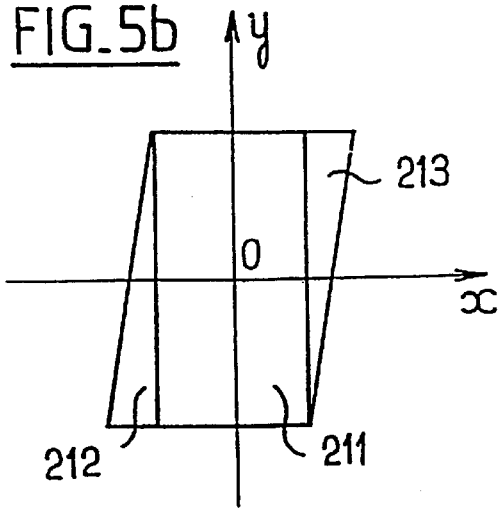
FIG. 5*b* shows a second example of a deflecting panel for an indicator light in accordance with the invention, in orthogonal projection along the optical axis.

Although FIG. 5*a* represents a panel in which the lateral zones 212 and 213 together cover, in projection, an area which is the same as that of the central zone 211, this particular feature is of course only optional. Thus for example, FIG. 5*b* shows the case where the two zones 212 and 213 together cover a rectangle of the same height as, but narrower than, the rectangle covered by the central zone 211. In this case, since the deviation law in the lateral zones 212 and 213 in terms of the "x" direction, by transformation, is more constricted than for the zone 211, these lateral zones, which are still concave, have smaller radii of curvature than the zone 211. They do however perform the same optical function as those in FIG. 5*a*, with both of them integrally filling the field of illumination CE.

Figure 5C:
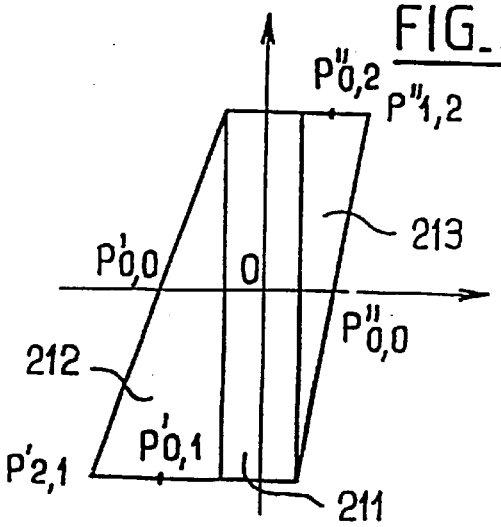
FIG. 5*c* shows a third example of a deflecting panel for an indicator light in accordance with the invention, in orthogonal projection along the optical axis.

A further example is shown in FIG. 5*c*, which shows the case where the lateral zones 212 and 213 are asymmetrical. Here the base width of the zone 212 is greater than the top width of the zone 213. The same optical behaviour can still be obtained here, because the law by which the horizontal deviation in terms of the "x" dimension evolves will be more constricted in the zone 213, this being obtained by simple transformation.

The three configurations shown in FIGS. 5*a* and 5*c* thus unable deflecting panel contours to be obtained with horizontal upper and lower sides and with lateral sides which are oblique in projection, with an angle of obliquity which can be varied at will, and with a choice between parallelism or non-parallelism between these lateral sides.

It will of course be understood that, by transposing the above explanations to the case in which the central zone 211 is completed by zones 212 and 213 which are not situated laterally with respect to the central zone, but being instead above and below it, it is possible to form deflecting panels which have the same properties in terms of filling a given rectangular field of illumination, but in which the lateral sides will be vertical, the upper and lower sides being oblique, whether or not they are parallel.

Figure 6A:
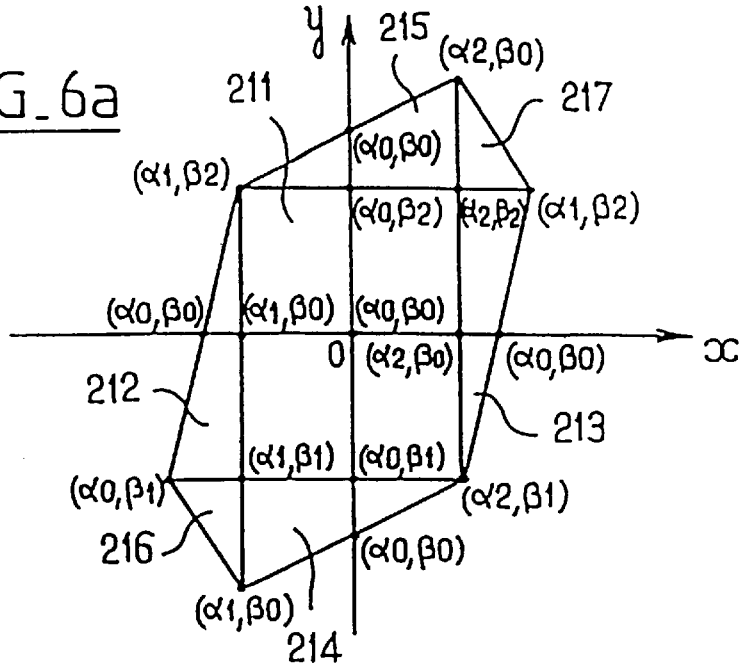
FIG. 6*a* shows a fourth example of a deflecting panel for an indicator light in accordance with the invention, in orthogonal projection along the optical axis.
Figure 6B:
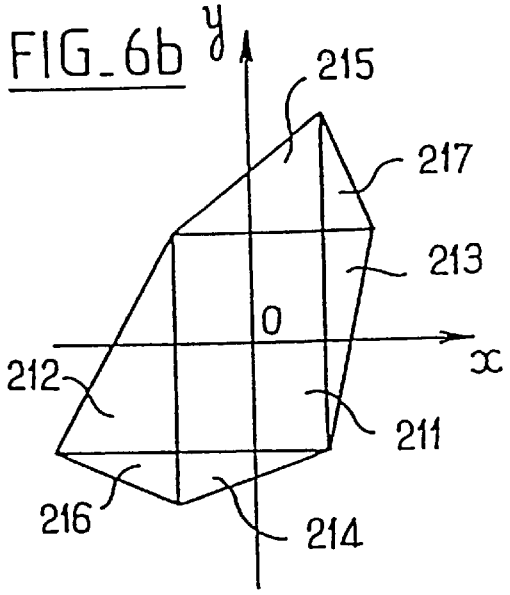
FIG. 6*b* shows a fifth example of a deflecting panel for an indicator light in accordance with the invention, in orthogonal projection along the optical axis.
Figure 6C:
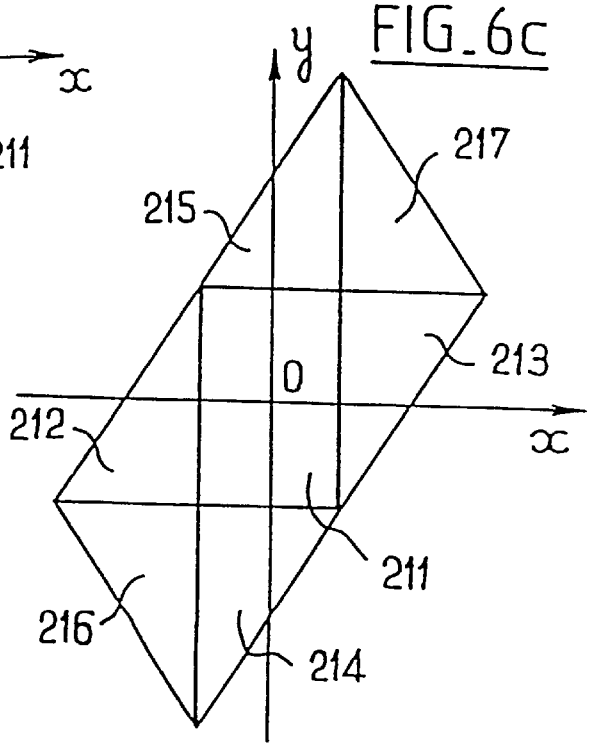
FIG. 6*c* shows a sixth example of a deflecting panel for an indicator light in accordance with the invention, in orthogonal projection along the optical axis.

Reference is now made to FIGS. 6*a* to 6*c*. FIG. 6*a* shows, in orthogonal projection on the optical axis, a deflecting panel which can be given a hexagonal contour by different configuration of the surfaces by which the central zone is extended. More precisely, the panel shown in FIG. 6*a* has a central zone 211, two triangular lateral zones 212 and 213 which are defined in the manner described above, in particular with reference to FIG. 5*b*, and four further triangular peripheral zones. These further zones comprise an upper zone 214, a lower zone 215, and two corner or diagonal zones 216 and 217.

The lower and upper zones 214 and 215 are obtained using the same approach as for the zones 212 and 213, but by adjustment of the vertical deflection laws in terms of the "y" direction. More precisely, the zones 214 and 215, if juxtaposed along their hypotenuse, would together define a surface with a concave vertical profile producing a vertical upward deflection that varies between $\beta 2$ and $\beta 1$, passing locally through a deflection $\beta 0$. Thus the surfaces of the two zones 214 and 215 extend the surface of the central zone 211 downwards and upwards with continuity and without any sudden change of gradient, so that together the zones 214 and 215 cover the field of illumination CE.

The triangular zones 216 and 217, at the bottom left hand corner and the top right hand corner of the panel in FIG. 6*a* respectively, are contiguous with the zones 212, 214 and 213, 215 respectively. The corner zones 216 and 217 meet the central zone 211 at their corners. Each of these corner zones comprises a surface which extends that of the corresponding zones 212, 214 or 213, 215 with continuity and without any sudden change of gradient. The horizontal and vertical profiles of the zones 216 and 217 are the inverse of those in the central zone 211. More precisely, if the zones 216 and 217 were juxtaposed along their hypotenuse, a surface would be obtained which, going from left to right in FIG. 6*a*, ensures a horizontal deflection between $\alpha 2$ and $\alpha 1$, and which, in the upward direction, provides a vertical deflection between $\beta 2$ and $\beta 1$. These two surfaces are concave in both horizontal and vertical profile, and again, they together fill the field of illumination CE. FIG. 6*a* indicates the horizontal and vertical deflections obtained at various points on the deflecting panel.

Thus, when the panel 21 of FIG. 6*a* is observed within the field of illumination CE, four secondary light sources can be seen. These are produced, respectively, by:

- the central zone 211;
- zone 212 or zone 213, depending on the point of observation;
- zone 214 or zone 215, depending on the point of observation; and
- zone 216 or zone 217, depending on the point of observation.

The hexagonal deflecting panel shown in FIG. 6*a* is designed with a symmetry of revolution through 180 degrees. However, it is of course possible to construct an asymmetrical panel, and one example of such a panel is illustrated in FIG. 6*b*. In this case, and in a manner analogous to that in FIG. 5*c* described above, the laws by which the horizontal or "x" deflection, and/or the vertical or "y" deflection, are developed are constricted to the extent that the zones are narrow in the corresponding dimension.

In addition, the design of such a hexagonal deflecting panel can easily be extrapolated to a contour in the form of a quadrilateral having sides which are neither vertical nor horizontal. An example of this is shown in FIG. 6*c*. More precisely, in this case, if the dimensions of the various zones are adjusted such that the hypotenuse of the triangle constituting the outer edge of the zone 212, and the hypotenuse of the triangle constituting the outer edge of the zone 215, are aligned with each other as shown, and that the hypotenuse of the triangle constituting the edge of the zone 214 and the hypotenuse of the triangle constituting the edge of the zone 213 shall be aligned as shown, then the quadrilateral obtained has the same properties. In other words, this quadrilateral covers essentially only the rectangular field of illumination CE and produces four secondary light sources at any point of observation within this field of illumination.

In addition, if the hypotenuses of the triangles 212 and 215 and the hypotenuses of the triangles 214 and 213 are parallel to each other, then a quadrilateral is obtained which has two parallel oblique sides. Besides this, if the hypotenuses of the triangles 216 and 217 are made parallel with each other, a parallelogram is obtained in which all of its sides are oblique. This parallelogram may become a rectangle by giving the hypotenuses of the triangles 216 and 217 an orientation at right angles to the hypotenuses of the triangles 212 to 215.

Finally it will be noted that if the above mentioned condition of alignment of the hypotenuses with each other is fulfilled only on one side, for example in the triangles 212 and 215, then a pentagonal deflecting panel will be obtained.

It has been explained above that the surface of the central zone 211 of the deflecting panel, which determines those of its peripheral zones, was constructed by applying, firstly, the three-dimensional coordinates of a point in the zone 211 (for example its centre), and secondly, two laws for the evolution or development of the deflections, namely $\alpha=f(x)$ and, $\beta=g(y)$.

Figure 7A:
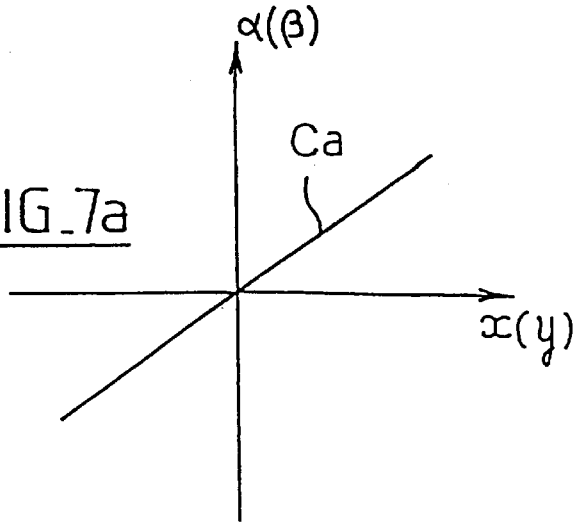
FIGS. 7*a* to 7*c* show in graphic form various possible horizontal or vertical deflection laws for a portion of a deflecting panel such as that shown in FIG. 4.

Reference is now made to FIG. 7*a*, which illustrates the case of a linear law (represented by the curve Ca), wherein the light is distributed horizontally or vertically in a relatively homogeneous manner by the deflecting panel.

Figure 7B:
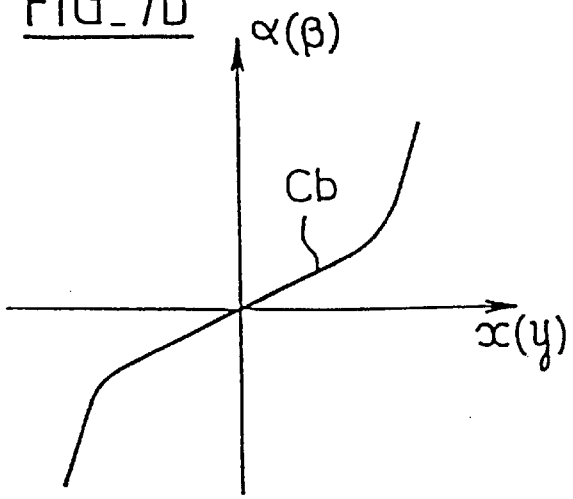

However, in some cases it may be desirable, especially where the photometric regulations so require, to distribute the light in a different way, for example by providing a greater concentration of light in the middle of the field of illumination CE. In that case, a distribution law of the kind shown by way of example on the curve Cb in FIG. 7*b* will be used. This enables the extent of that part of the profile, for which small deflections $\alpha$ or $\beta$ are obtained, to be increased.

Figure 7C:
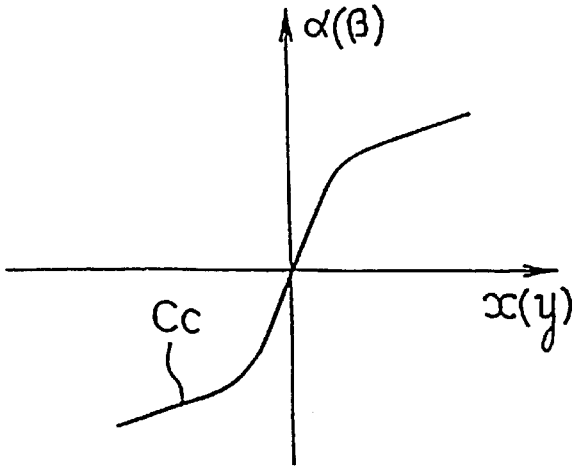
Figure 8A:
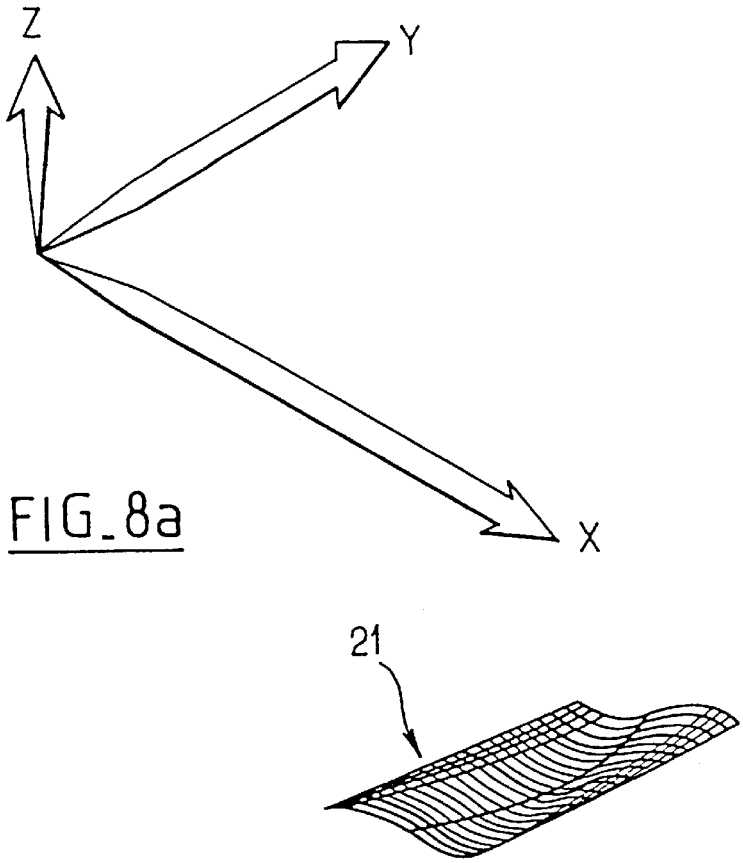
FIGS. 8*a* to 8*d* show, from four different angles of observation, the appearance of a deflecting panel of an indicator light reflector in accordance with the invention.
Figure 8B:
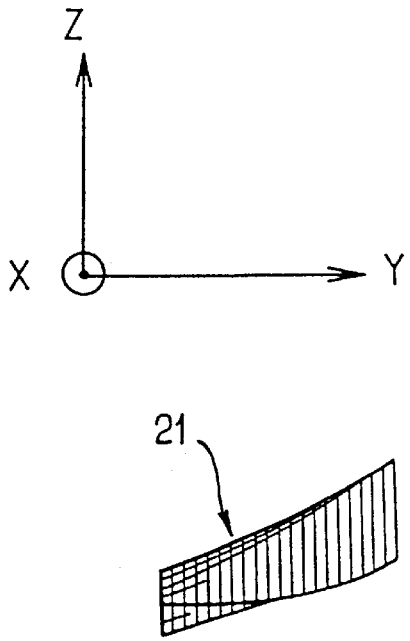
Figure 8C:
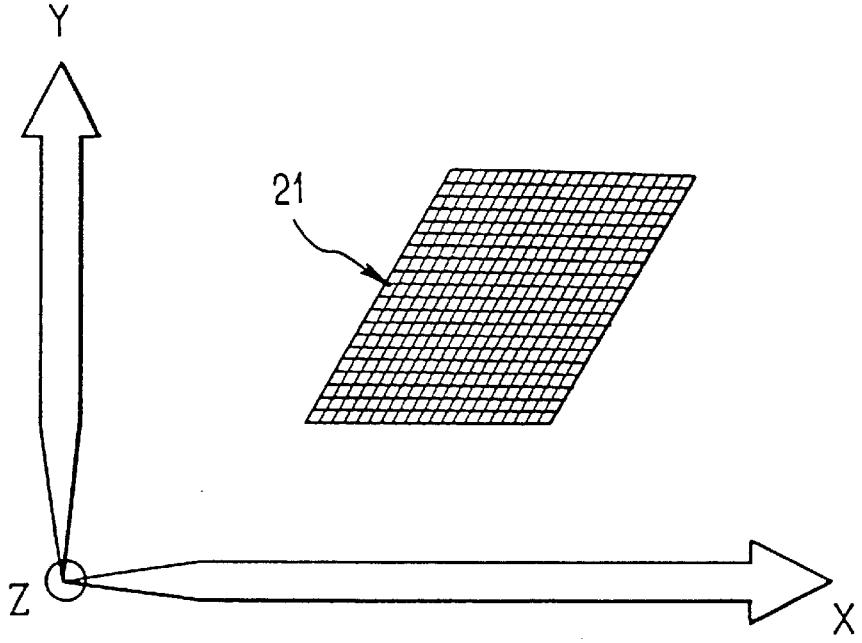
Figure 8D:
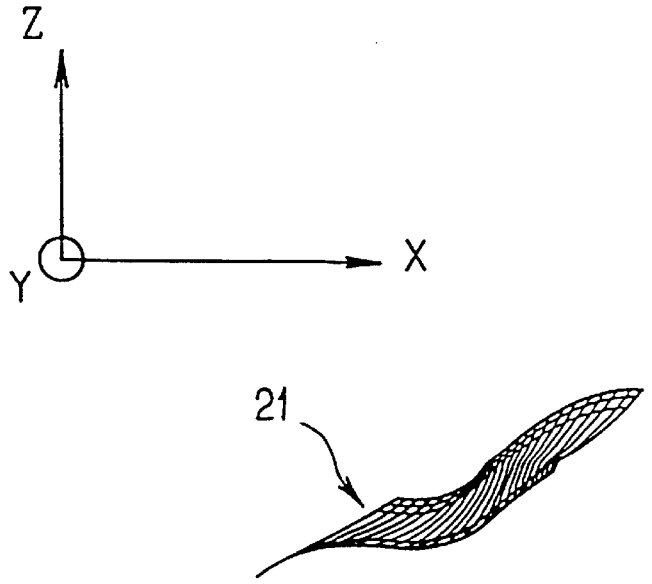

Conversely, a distribution law of the type shown, by way of example, in FIG. 7*c*, reduces the extent of that part of the profile for which small deviations $\alpha$ or $\beta$ are obtained, and thus, gives greater light intensities in the marginal zones of the field of illumination.

It will of course be understood that any other distribution law may be envisaged, and in particular an asymmetrical law.

Reference is now made to FIGS. 8*a* to 8*d*; in accordance with the invention these figures relate to the appearance of a deflecting panel 21 and illustrate its appearance as seen from different viewpoints, the viewpoint in each case being that for which the Cartesian coordinates indicated in each of these four Figures is oriented as shown. In these cases, the panel 21 is a panel having a contour in the form of a parallelogram, which corresponds to the parallelogram shown in FIG. 5*a*.

It will be observed in FIGS. 8*a* to 8*d* that the surface of the panel displays contortions which are linked to the inversion of its curvature at the transition between the central zone and the lateral zones of the panel.

In a further embodiment of the invention which is not shown in the drawings, configurations can be provided which give some degree of homogeneity to the intensity of the different secondary light sources generated by the various deflecting panels. More precisely, it is well known that for an equal surface area, a deflecting panel situated closer to the source than another deflecting panel will cover (as seen from the source) a solid angle which is larger than that for the other panel. As a consequence, it receives more light, and the intensity of the secondary sources produced is greater. In order to attenuate this effect, it is preferably arranged that a set of deflecting panels closest to the source (and typically arranged in the vicinity of the base of the reflector) are defined with deflection laws f and g, i.e. the equations governing the direction of the light, which direct the light by a greater amount in the lateral and/or vertical direction. In this way, the intensity of the secondary light sources produced is diminished, and may become close to that of the secondary sources produced by the other deflecting panels.

It will be clear that in this case, lighting up and extinction of the secondary sources, when the eye of the observer crosses the limits of the field of illumination, can lose some of its simultaneous character. The person skilled in the art will be able to balance these conflicting advantages with each other in accordance with styling requirements.

As can be seen in particular in FIG. 2, to which reference is now made, the indicator light includes a screen 40 which is located in front of the lamp 10. The purpose of the screen 40 is mainly to mask the lamp when the indicator light is extinguished, while having an appearance very similar to that of the reflector 20 when seen through the cover lens 30 and, where appropriate, also through an intermediate screen if provided. In the present example, the screen 40 is fixed to the body of the indicator light through an upper mounting element 41 and a lower mounting element 42. These mounting elements 41 and 42 are preferably oriented obliquely, and parallel to the deflecting panels 21 of the reflector 20. It is, however, possible, of course to envisage, other methods of fastening the screen, for example, and especially, by fastening it on the body of the indicator light.

In addition, it is of advantageous in this case for the screen 40 to be in the form of a parallelogram, with upper and lower edges, and side edges, parallel to the deflecting panels 21 of the reflector 20, so as to enhance the impression that it is an integral part of the indicator light.

It is an essential feature of the present invention that the screen 40 consist of a translucent material (which may or may not be a colored), and has a face on which reliefs or hollows are formed, these reliefs or hollows providing backward reflection, of the catadioptric type or, preferably, a reflection of the "pseudo-catadioptric" type, in which the reflected radiation has a slight angular offset with respect to the incident radiation.

Conventionally, perfect backward-reflective, or retro-reflective, reliefs have the form of trihedrons defined by corners of a cube. "Pseudo-catadioptric" or "false catadioptric" behaviour can be obtained by replacing the perfect corners of cubes either by trihedrons in which the angles between their surfaces are slightly different from 90 degrees, as disclosed in French patent No. FR 2 589 983 A to Valeo Vision S.A. (Valeo), or by conical points having appropriate apex angles as described, in particular, in French patent No. FR 2 685 440 A to Valeo.

The "false catadioptric" type of behaviour is used mainly where the presence of true catadioptric elements at the point concerned in the indicator light would be incompatible with the appropriate regulations, or incompatible with the relevant specifications.

Figure 9:
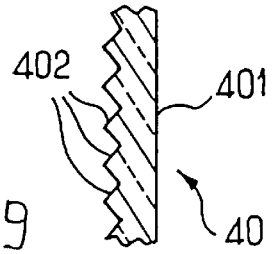
FIG. 9 is a scrap view in vertical cross section, on an enlarged scale, of a masking screen in the indicating light shown in FIG. 2.

Thus for example, FIG. 9 shows part of a screen comprising a plate 40 having an outer or front surface 401 (on the same side as the cover lens) which is smooth, and an inner or rear surface which is formed with catadioptric or pseudo-catadioptric needles 402. If the plate 40 is made of an uncoloured material, then, when the indicator light is extinguished and exposed to a diffuse ambient light, the screen then presents a relatively brilliant appearance which is similar to that of the reflector 20. In this basic embodiment of a screen in accordance with the present invention, the screen allows a reduced quantity of light from the lamp to pass through it, towards the cover lens 30, when the lamp is lit.

Figure 10:
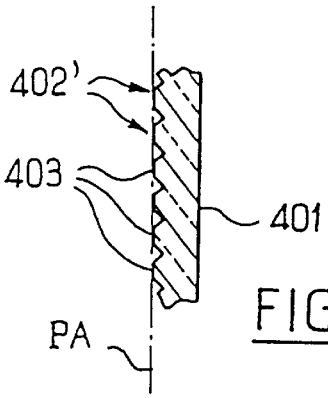
FIG. 10 is a scrap view in vertical cross section and on an enlarged scale, showing part of a masking screen in a first modified embodiment of the invention.

FIG. 10 shows another version of the screen, in which the tips of the needles, indicated by the reference numeral 402', are truncated so as to have flat terminal surfaces 403 which lie in a common flattening plane PA, which is preferably parallel to the plane of the smooth outer surface 401 of the plate 40. These coplanar flat end surfaces define, with the outer face 401, optics with parallel faces, which constitute a corresponding number of windows for passage of the light emitted by the lamp towards the cover lens. It is thus, easy to adjust the intensity of the direct light delivered by the combination of the lamp 10 and the screen 40, by adjusting the amount by which the tips of the needles are reduced in height. In addition, the needles can be reduced in height by different amounts, giving different common planes for their terminal surfaces, so enabling the proportion of light passed through the screen to be varied as between one zone of the screen and another.

The screen is designed to generate, in the vicinity of its outer face, a plurality of further secondary light sources which are in the image of the primary light source constituted by the lamp filament 11. The screen is also designed so that the geometrical distribution of these further secondary light sources is similar to that of the secondary light sources generated by the deflecting panels of the reflector.

Figure 11:
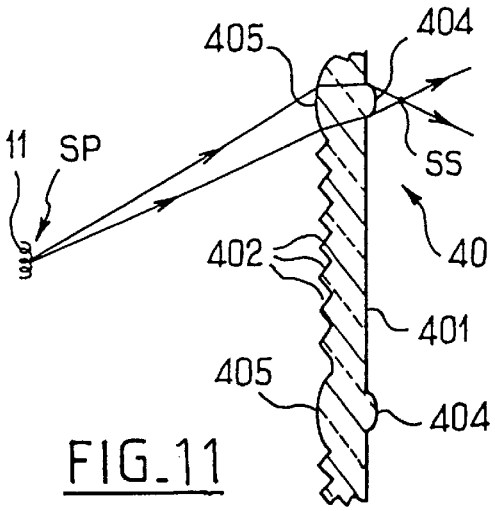
FIG. 11 is a scrap view in vertical cross section, on an enlarged scale, showing part of a masking screen in a second modified embodiment of the invention.
Figure 12:
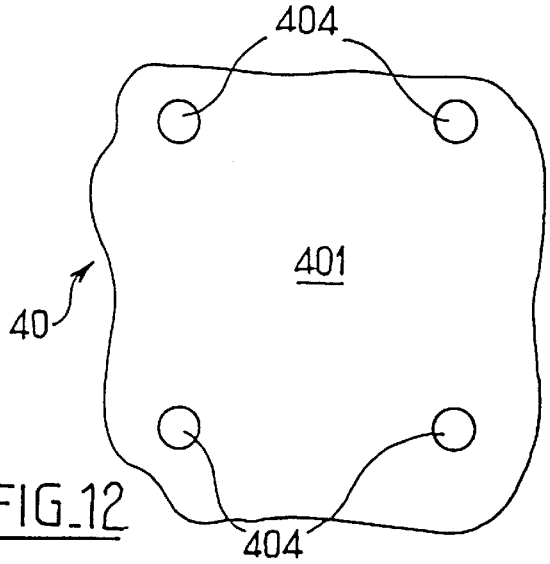
FIG. 12 is a front view showing part of the same screen as is shown in FIG. 11.

Thus, referring to FIGS. 11 and 12, these Figures show the zone of catadioptric elements 402 arranged on the inner face of the screen. This zone is interrupted in various locations to define convex surfaces 405 at those locations. In line with each of these surfaces 405, a further convex surface 404 is formed on the outer face 401 of the screen. The combination of surfaces 404 and 405 in pairs, in which each pair constitutes a bi-convex lens, is so determined that an image of the primary source SP, constituted by the lamp filament 11 (this image constituting a secondary light source SS) is formed outside the surface 404 and is visible in the same field of observation as the sources created by the various deflecting panels 21 of the reflector 20.

FIG. 12 shows that the distribution of the pairs of surfaces 404 and 405, which define the same distribution of secondary sources SS, is arranged in horizontal and vertical rows, with a predetermined pitch between them. This configuration is particularly suitable where the deflecting panels of the reflector are separated by horizontal and vertical transition planes, preferably having the same pitch distances.

Figure 13:
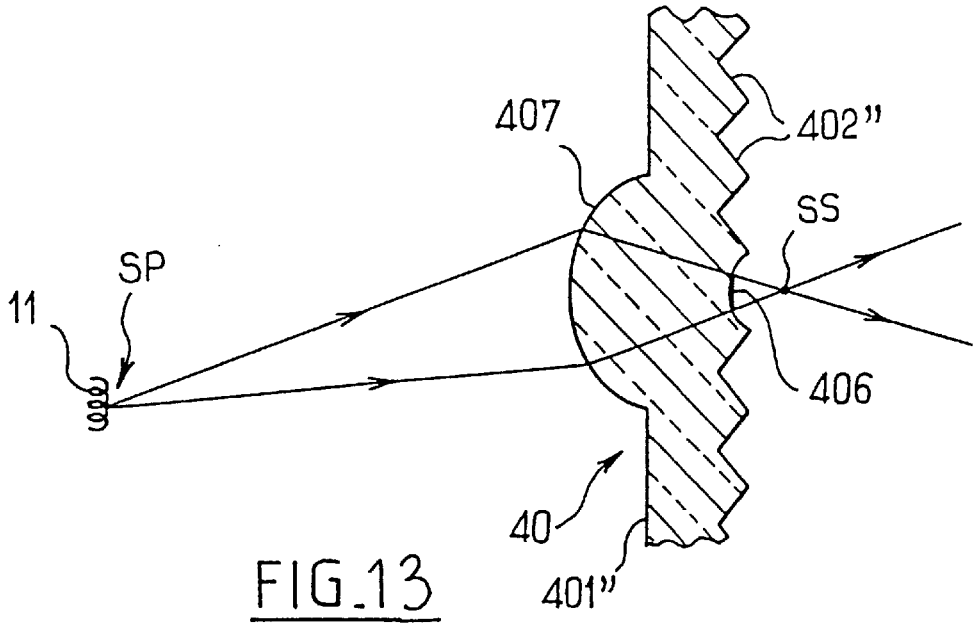
FIG. 13 is a scrap view in vertical cross section and on a larger scale, showing part of a screen in a third modified embodiment.

Referring to FIG. 13, which shows a further embodiment of a screen that produces secondary light sources. In this embodiment, the catadioptric or pseudo-catadioptric trihedrons (or the cones), which are designated by the reference numeral 402", are arranged on the outer surface of the screen, and operate not in internal reflection as before, but in external reflection. This gives a less brilliant appearance, when the indicator light is extinguished than in the foregoing embodiments. By contrast, in this case it is possible to produce secondary light sources with optical means which occupy a smaller amount of space on the outer face of the screen, thus giving the latter a very satisfactorily homogeneous aspect when the indicator light is extinguished. More precisely, some of the catadioptric elements are truncated at their base by small surfaces 406 which are for example, plane surfaces, or else are in the form of concave or convex spherical or toroidal surfaces. In line with these surfaces 406, on the inner face of the screen, which is also smooth in the zones 401", convex surfaces 407 are formed. These surfaces 407 cooperate with the surfaces 406 to form secondary light sources SS, which are organised geometrically as in the case of FIGS. 11 and 12.

The surface 407 is so designed as to converge the light from the filament 11 on the surface 406, as to obtain secondary light sources of sufficient intensity, this intensity being governed by the effective surface area attributed to the surface 407.

The surface 407 is preferably in the form of a Descartes stigmatic oval, between the position of the light source 11 and the centre of the associated surface 406. It will be noted that the form of the surface 406 itself is such as to adjust, if necessary, the horizontal and vertical direction of the light as it leaves the upstream surface 407, in order that the secondary light sources which are created shall be perceptible within the required field of observation. Thus, the surfaces 406 may even be flat, where the surfaces 407 direct the light in the required way by themselves. The surfaces 406 may also be cylindrical where an adjustment in the direction of the light is required in only a single direction.

Thus, the embodiment of FIG. 13 enables the required intensity of the secondary light sources to be easily obtained without detriment to the homogeneity of the appearance of the external face of the screen.

It will be observed that in the embodiment of FIGS. 11 and 12, the convex internal surface 405 may be a Descartes stigmatic oval, on the filament 11 and on a point situated either in the vicinity of the external surface of the screen or on a point located further away from that surface, so that the light will be concentrated by the surface 405 substantially over the whole area of the homologous surface 404.

Figure 14:
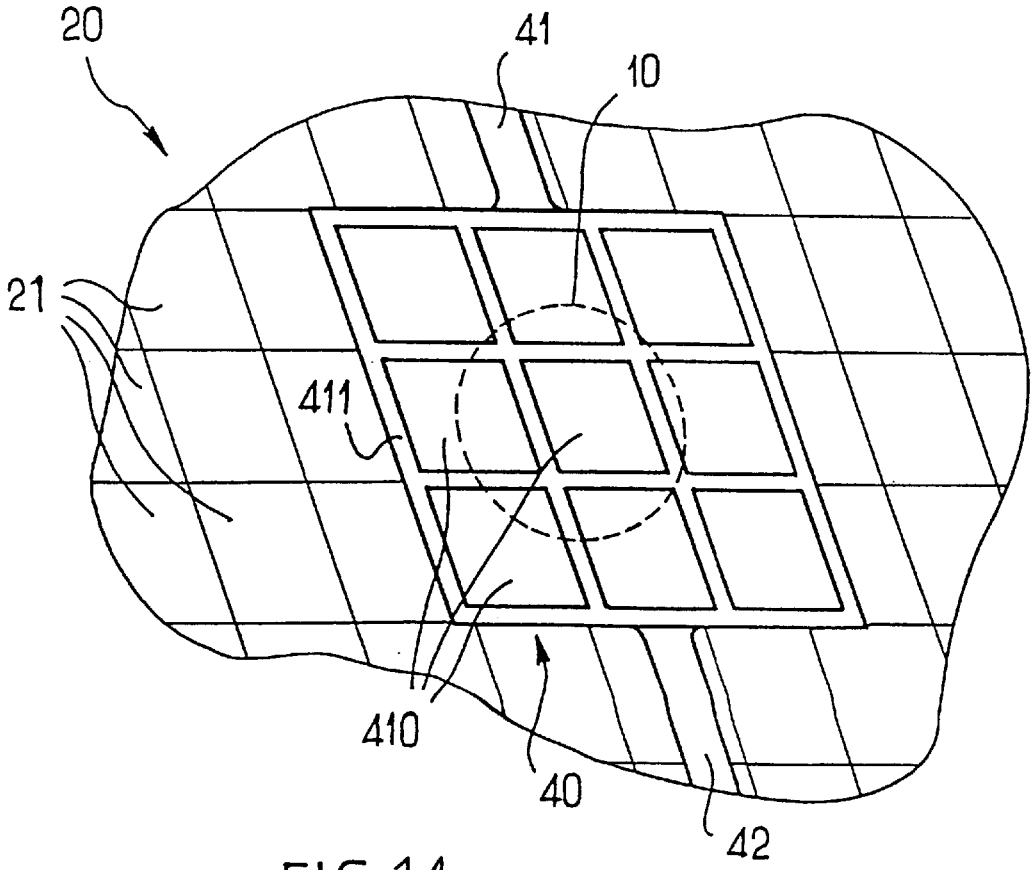
FIG. 14 is a front view showing part of a screen in a fourth modified embodiment of the invention, together with an adjacent portion of the reflector of the indicator light.

Referring to FIG. 14, which illustrates the particular embodiment in which the reflector 20 of the indicator light is delimited by a certain number of reflective panels 21 which in flat projection are in the form of parallelograms. The catadioptric or pseudo-catadioptric elements of the screen are sub-divided into different zones 410, all of substantially the same form and the same dimensions as the panels 21. These zones 410 are separated by two narrow zones 411, having a visual aspect which is distinguished, to a greater or lesser extent depending on the effect required, from the zones 410. These separation zones 411 are for example smooth on both of their faces, and/or they are coated with an opaque paint. Alternatively, where appropriate, they may be provided with optical elements having a visual aspect, when the indicator light is extinguished, different from the aspect of the catadioptric or pseudo-catadioptric elements.

The present invention is no way limited to the various embodiments described above and shown in the drawings, and the person skilled in this art will be able to apply any variant or modification within the spirit of the invention. In particular, although in the foregoing a central zone 211 of a panel 21 has been described as being of the convex type, with peripheral zones that are partly convex and partly concave (for example the zones 212 to 215) or entirely concave such as the zones 216 and 217, it will be understood that the reverse may apply, with the starting point then being a concave central zone 211.

Finally, it will be understood that the present invention offers great flexibility in design for the contours of the various reflective panels, and consequently enables a reflector to be designed for an indicator light, in which the reflector has panels or facets of very diverse forms and dimensions.

In addition, although a screen of generally flat form has been described, the screen can in fact, with advantage, have a concavity on the same side as the lamp 10, which provides better masking for the lamp from outside with an equal surface area.

Moreover, in the case where the indicator light is required to produce a colored light beam, this color may be obtained in various ways. Examples of such ways include, in particular, providing a lamp 10 with a colored globe, or a specific coloured globe surrounding the lamp and masked by the screen; or by providing a colored intermediate screen located within the cover lens; or by coloring the cover lens itself. Colored lights may be obtained from any combination of these arrangements.

What is claimed is:

1. An indicating light for a motor vehicle comprising: a light source; a reflector associated with the light source for defining an optical axis of the indicating light; and a cover lens in front of the reflector, the reflector comprising a set of deflecting panels adjacent to each other, each deflecting panel having a reflective surface, the reflective surfaces of adjacent deflecting panels being continuous with each other, each deflecting panel distributing light from the light source through the cover lens within a predetermined field of illumination, the field of illumination having a horizontal dimension and a vertical dimension, the cover passing light without significant deflection, wherein each deflecting panel comprises a central zone and at least one pair of peripheral zones extending beyond the central zone, each pair of peripheral zones being disposed on opposite sides of the central zone, the central zone having a rectangular contour, including horizontal and vertical sides, in orthogonal projection on the optical axis, such that light reflected from the central zone covers the whole of the field of illumination, the peripheral zones having oblique sides, such that light reflected from the pair of peripheral zones substantially covers the whole of the field of illumination.

2. An indicator light according to claim 1, wherein the central zone of each deflecting panel is defined by a first evolution law and a second evolution law; the first evolution law defining the evolution of the horizontal deflection of light from the light source by the central zone in terms of a horizontal direction, and the second evolution law defining the evolution of the vertical deflection of light from the light source by the central zone in terms of a vertical direction, the pair of peripheral zones being defined by a third evolution law identical to one of the first and second evolution laws, and by a fourth evolution law inverse to the other one of the first and second evolution laws.

3. An indicator light, according to claim 1, wherein each of the peripheral zones has a triangular contour, in orthogonal projection, having a first side coincident with one side of a central zone, a second side extending beyond an adjacent side of the central zone, and a third side constituting said oblique side of the peripheral zone, said third side being a hypotenuse of the triangle.

4. An indicating light for a motor vehicle comprising: a light source; a reflector associated with the light source; and a cover lens in front of the reflector, the reflector comprising a plurality of groups of deflecting panels adjacent to each other, each of the deflecting panels being continuous with each other without any sudden change in gradient, each deflecting panel for distributing light from the light source, incident on the reflective surface of the panel, through the cover lens within a predetermined field of illumination, the field of illumination having a horizontal dimension and a vertical dimension, the cover lens passing light without significant reflection, wherein each deflecting panel in at least one group of said deflecting panels has a sinuous profile in a cross section of at least one of the horizontal and vertical dimensions each deflecting panel generating at least two virtual light sources being visible at any angle of observation within a field of observation.

5. An indicating light for a motor vehicle comprising: a light source; a reflector associated with the light source; and cover lens in front of the reflector, the reflector comprising a plurality of deflecting panels adjacent to each other, each deflecting panel having a reflective surface, the reflective surfaces of adjacent deflecting panels being continuous with each other without any sudden change of gradient, each deflecting panel distributing light from the light source, incident on the reflective surface of the panel, through the cover lens within a predetermined field of illumination, the field of illumination having a horizontal dimension and a vertical dimension, the cover lens passing light without significant deflection, wherein at least some of said deflecting panels have a contour, in orthogonal projection along the optical axis, including at least two opposed oblique sides, the field of illumination being essentially rectangular including a plurality of horizontal edges and a plurality of vertical edges, the deflecting panels reflecting light from the light source into the field.

6. An indicator light for a motor vehicle comprising: a lamp; a reflector associated with the lamp; a cover lens in front of the reflector, and a screen disposed between the lamp and the cover lens for masking the lamp, wherein light from the lamp incident on the reflector is reflected by the reflector through the cover lens within a predetermined field of observation, the reflector comprising a set of deflecting panels adjacent to each other creating a plurality of first secondary light sources visible within the field of observation, the screen comprises a translucent plate having a front face and a rear face, retro-reflective optical means on one of said faces of the screen, means for generating second secondary light sources in a distribution similar to the distribution of the first secondary light sources, the second light sources being visible over substantially the same field of observation as the first secondary light sources.

7. An indicating light according to claim 6, wherein the rear face of the plate includes zones without retro-reflective means, the zones constituting windows for allowing light to pass through the screen, each zone having a convex surface constituting the means for generating the second secondary light sources.

8. An indicator light according to claim 7, wherein the windows correct the direction of the light obtained by means of the convex surfaces, such that the light fills the field of observation.

9. An indicator light according to claim 6, wherein the retro-reflective means are distributed in zones of the screen having contours to reinforce homogeneity of aspect with the deflecting panels of the reflector.

10. An indicator light according to claim 9, wherein the screen includes substantially smooth narrow zones for providing separation between each of the zones having the retro-reflective means.

* * * * *